US008905858B2

(12) United States Patent
Nivanh et al.

(10) Patent No.: US 8,905,858 B2
(45) Date of Patent: Dec. 9, 2014

(54) CLUB HEAD WITH INSERT INCLUDING SECURING MEMBER ON OUTER SURFACE

(75) Inventors: Dan S. Nivanh, Tustin, CA (US); Keith F. Dolezel, Covina, CA (US)

(73) Assignee: Dunlop Sports Co., Ltd., Kobe-Shi (JP)

( * ) Notice: Subject to any disclaimer, the term of this patent is extended or adjusted under 35 U.S.C. 154(b) by 102 days.

(21) Appl. No.: 13/567,558

(22) Filed: Aug. 6, 2012

(65) Prior Publication Data

US 2014/0038743 A1 Feb. 6, 2014

(51) Int. Cl.
*A63B 53/04* (2006.01)
*A63B 53/00* (2006.01)

(52) U.S. Cl.
CPC ..... *A63B 53/00* (2013.01)
USPC ..... 473/324; 473/334

(58) Field of Classification Search
CPC ..... A63B 53/00; A63B 2071/0694; F41B 21/082; F41B 21/086
USPC ..... 473/282, 324, 345, 346, 334, 335; 40/1.5, 591, 661.09, 661.11; 411/363, 411/502, 508
See application file for complete search history.

(56) References Cited

U.S. PATENT DOCUMENTS

| | | | | |
|---|---|---|---|---|
| 1,830,936 | A * | 11/1931 | Faith | 40/631 |
| 3,803,670 | A * | 4/1974 | Johnson | 411/508 |
| 3,842,709 | A * | 10/1974 | Fuqua | 411/350 |
| 4,380,337 | A * | 4/1983 | DiMatteo | 473/285 |
| 4,403,377 | A * | 9/1983 | Mizusawa | 24/681 |
| 4,822,052 | A * | 4/1989 | Dimmick et al. | 473/285 |
| 4,841,100 | A * | 6/1989 | Ignasiak | 174/138 G |
| D318,704 | S | 7/1991 | Cevert | |
| D319,862 | S | 9/1991 | Lahger | |
| 5,255,918 | A | 10/1993 | Anderson et al. | |
| 5,333,871 | A | 8/1994 | Wishon | |
| 5,447,311 | A | 9/1995 | Viollaz et al. | |
| 5,509,660 | A | 4/1996 | Elmer | |
| 5,547,194 | A | 8/1996 | Aizawa et al. | |
| 5,706,559 | A * | 1/1998 | Oliver et al. | 267/49 |
| 5,720,673 | A | 2/1998 | Anderson | |
| 5,749,794 | A | 5/1998 | Kobayashi et al. | |
| 5,800,285 | A * | 9/1998 | Thorne et al. | 473/324 |
| 6,045,456 | A | 4/2000 | Best et al. | |
| 6,238,303 | B1 | 5/2001 | Fite | |
| 6,488,594 | B1 | 12/2002 | Card et al. | |
| 6,743,117 | B2 | 6/2004 | Gilbert | |
| D508,969 | S | 8/2005 | Hasebe | |
| 6,981,924 | B2 | 1/2006 | Deshmukh | |
| 7,004,853 | B2 | 2/2006 | Deshmukh | |
| 7,014,571 | B2 | 3/2006 | Deshmukh | |
| 7,022,031 | B2 | 4/2006 | Nishio | |
| 7,066,834 | B2 | 6/2006 | Yamamoto | |

(Continued)

FOREIGN PATENT DOCUMENTS

| | | |
|---|---|---|
| JP | A-11-244433 | 9/1999 |
| JP | A-2004-351154 | 12/2004 |

*Primary Examiner* — William Pierce
(74) *Attorney, Agent, or Firm* — Oliff PLC

(57) ABSTRACT

Generally, provided is an insert for usage on an outer surface of a sporting apparatus (e.g., a golf club). The insert includes a securing member that protrudes from surface of the insert. The securing member may include a stem and a head, wherein the stem functions to couple the head to a face of the securing member. The head of the securing member functions to prevent the insert from becoming dislodged or separated from the outer surface of the sporting apparatus during usage.

17 Claims, 5 Drawing Sheets

(56) References Cited

U.S. PATENT DOCUMENTS

| | | | | |
|---|---|---|---|---|
| 7,112,148 | B2 | 9/2006 | Deshmukh | |
| D530,767 | S | 10/2006 | Davis et al. | |
| 7,121,958 | B2 | 10/2006 | Cheng et al. | |
| 7,198,315 | B2 * | 4/2007 | Cass et al. | 296/29 |
| 7,220,189 | B2 | 5/2007 | Wieland et al. | |
| 7,462,110 | B2 | 12/2008 | Yamamoto | |
| 7,491,136 | B2 | 2/2009 | Deng et al. | |
| 7,572,194 | B2 | 8/2009 | Yamamoto | |
| 7,628,707 | B2 * | 12/2009 | Beach et al. | 473/131 |
| 7,648,791 | B2 * | 1/2010 | Sakano et al. | 429/483 |
| D627,021 | S | 11/2010 | Savarese et al. | |
| 7,883,431 | B2 | 2/2011 | Matsunaga et al. | |
| D633,966 | S | 3/2011 | Savarese et al. | |
| 8,033,931 | B2 | 10/2011 | Wahl et al. | |
| 8,088,025 | B2 | 1/2012 | Wahl et al. | |
| 8,092,318 | B2 | 1/2012 | Oldknow et al. | |
| D658,248 | S | 4/2012 | Nunez et al. | |
| 8,157,668 | B2 | 4/2012 | Wahl et al. | |
| D664,027 | S * | 7/2012 | Vosika et al. | D8/382 |
| 8,298,096 | B2 * | 10/2012 | Stites et al. | 473/334 |
| 8,419,565 | B2 * | 4/2013 | Karube | 473/297 |
| 8,601,647 | B2 * | 12/2013 | Hasegawa et al. | 24/297 |
| 2003/0064824 | A1 | 4/2003 | Takeda | |
| 2004/0266548 | A1 | 12/2004 | Cheng et al. | |
| 2005/0239575 | A1 | 10/2005 | Chao et al. | |
| 2006/0199661 | A1 | 9/2006 | Deng et al. | |
| 2010/0167836 | A1 * | 7/2010 | Horii et al. | 473/334 |
| 2010/0323807 | A1 | 12/2010 | Rha | |

* cited by examiner

CLUB HEAD WITH INSERT INCLUDING SECURING MEMBER ON OUTER SURFACE

COPYRIGHT AUTHORIZATION

The disclosure below may be subject to copyright protection. The copyright owner has no objection to the facsimile reproduction by any one of the documents containing this disclosure, as they appear in the Patent and Trademark Office records, but otherwise reserves all applicable copyrights.

BACKGROUND

A golf club's primary function is to strike a ball as precisely as possible to produce the desired distance and direction. With respect to a tee shot, by using a driver-type golf club to strike a ball, a golfer may be able to effectively minimize the remaining distance to the pin. It is not unusual for a seasoned golfer to drive the ball well over 200 yards. Some professional golfers can drive a ball well over 300 yards. Considering that a hole might be 400 or more yards away, driving the ball of this magnitude may be advantageous. However, to maximize drive distance, golfers may be required to swing the golf club (e.g., the driver) at speeds of well over 100 miles per hour.

At such speeds, upon impacting the ball, tremendous vibrations are triggered throughout the golf club originating at the point of impact at the striking face of the golf club head. Unfortunately, vibrations of such magnitude tend to weaken adhesive bonds between an insert (e.g., a badge, a plate, a medallion, plaque, etc.) and the golf club, thereby resulting in increased likelihood that the insert may become separated from the golf club.

In a very competitive market, a manufacturer producing a golf club having an externally-visible insert which easily falls off will likely cost the manufacturer in future sales and/or injure the reputation of the manufacturer, thereby impacting the sales of other lines of golf clubs produced by the manufacturer, and generally placing the manufacturer in an undesirable position. However, removing the inserts all-together and using paint, etching or other forms of brand indicia may reduce the aesthetic quality of the golf club, causing potential customers to favor other manufacturers which include inserts. For example, casting the golf club head to have the appearance of the insert, but without actually having a separate component for the insert has a significant drawback in that a level of detail available would be drastically reduced, thereby making the product appear cheaper and less desirable to the consumer. Furthermore, such an option would also prevent the ability of including a frame line which provides an additional aesthetic quality. Also, the ability to include external inserts on the golf club provides golf club designers added options to further distinguish the design and aesthetic feel of the golf club from its competitors.

In addition to keeping the insert securely in place on the surface of the golf club, any proposed solution to this problem should take into account other factors such as minimizing an increase in manufacturing complexity, minimizing an increase in manufacturing cost, maintaining performance of the club, maintaining the aesthetic quality of the club and the like.

Against this backdrop, many potential solutions were investigated. For example, adhesive tape with improved bonding qualities were studied and tested. However, even using an adhesive tape with improved bonding properties, the insert still could fall off the golf club head in as few as 100 strikes of the golf ball. While it is possible that certain known adhesives may provide increased durability, the cost of these adhesives may be prohibitive.

Other solutions, such as using a glue, were also problematic for similar reasons. Continued usage of the golf club resulted in decreased adhesion that often times led to the insert falling off the golf club.

Accordingly, what is needed is an improved method for preventing an insert from being separated from the surface of the golf club.

SUMMARY

This summary is included to introduce, in an abbreviated form, various topics to be elaborated upon in the Detailed Description. The foregoing objects, features and advantages described are not intended to be limiting and will become more apparent from the following detailed description, which proceeds with reference to the accompanying figures.

Generally provided is an insert for placement on an outer surface of a golf club, the insert having a securing member that protrudes from the surface of the insert. The securing member is intended to engage the golf club to keep the insert secured in place. The securing member may include a stem and a head, wherein the stem functions to couple the head to a face of the securing member. The head of the securing member functions to prevent the insert from becoming dislodged or separated from the outer surface of the golf club, for example, during swinging and/or subsequent striking of a golf ball.

An adhesive layer may also be used in conjunction with the insert to further ensure that the insert does not become dislodged or separated from the outer surface of the golf club. Indeed, the combined structure of the insert and the adhesive layer enhances the functionality of the adhesive layer by keeping the adhesive layer in contact with both the securing member and the golf club. As a result, even if the bonding qualities of the adhesive layer deteriorate over time, the insert may remain secured in place. Additionally, the adhesive layer may assist in ensuring that the securing member of the insert is firmly secured. More particularly, the presence of the adhesive layer creates a bias that tightens the fit between the securing member and the golf club.

In one embodiment, a golf club head may comprise a top portion, a striking face coupled to the top portion and a sole portion coupled to the striking face. The sole portion includes an inner surface and an outer surface, and further defines an aperture extending therethrough. The golf club may also include a uni-directional, non-rotatable insert having a face and a securing member, the securing member for contacting the inner surface of the sole portion for securing the insert to the sole portion.

In another embodiment, a golf club head may comprise a top portion, a striking face coupled to the top portion and a sole portion coupled to the striking face including a recessed portion defining an aperture. The recessed portion may have an inner wall and outer wall. The golf club head may also comprise a uni-directional, non-rotatable insert. More particularly, the insert may include a face, an adhering layer having a first surface for contacting and adhering to the face and having a second surface opposite the first surface for contacting and adhering to the recessed portion of the sole portion, and a securing member adjacent the second surface of the adhering layer, the securing member configured to be insertably locked into the sole portion.

In yet another embodiment, a golf club insert may comprise a face plate, a cushioning layer, a stem portion and a head portion. More particularly, the cushioning layer may include a first and second surface—the first surface for adhering to the face plate. The cushioning layer may have a thickness greater than 0.2 mm. The stem portion is coupled to the face plate on a first end and separated from the first surface and the second surface of the cushioning layer. At the second end of the stem portion is coupled a head portion, the head portion having a maximum diameter greater than a maximum diameter of the stem portion.

BRIEF DESCRIPTION OF THE DRAWINGS

The features, obstacles and advantages of the present application will become more apparent from the detailed description set forth below when taken into conjunction with the drawings, wherein.

DETAILED DESCRIPTION

Apparatuses, systems and/or methods that implement the embodiments of the various features of the present invention will now be described in reference to the drawings. The drawings and associated descriptions are provided to illustrate certain embodiments and are not to limit the scope of the present invention. Throughout the drawings, references are re-used to indicate correspondence between the referenced elements.

Generally, the concepts described herein relate to a golf club (e.g., a driver, fairway, iron, wedge, putter, etc.). However, these concepts can be applied to other devices in the sports industry (e.g., a hockey stick, a lacrosse stick, a tennis racket, a baseball bat, etc.). For the sake of clarity and brevity, the concepts will be described in detail below with respect to a driver-type golf club.

Figure 1A:
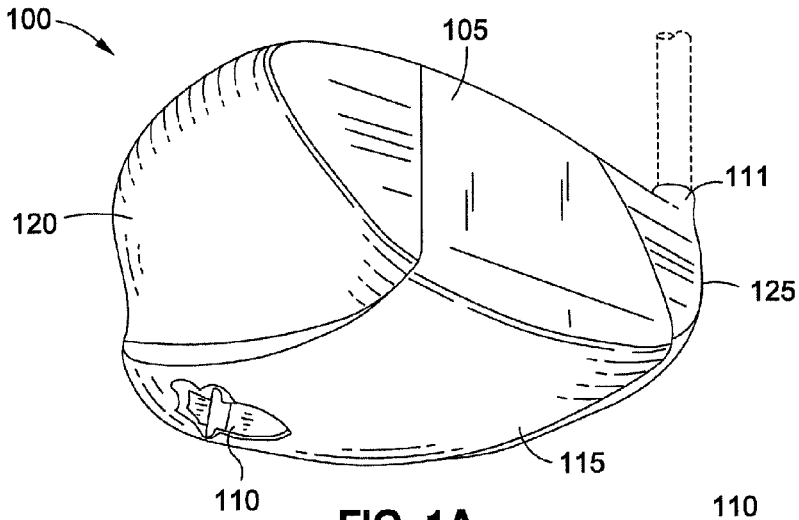
FIG. 1A is a perspective view of the golf club head according to one or more embodiments described herein.

As shown in FIG. 1A, a golf club head 100 typically includes body having a striking face 105, a hosel 111 and a sole portion 115. In this particular embodiment, an insert 110 is located on the outer surface of the sole portion 115, near a toe portion 120 and distal from the heel portion 125. The insert 110, while shown as a fanciful design, may be in any shape but preferably non-geometric to provide it with anti-rotation features. Furthermore, the insert 110 may display any desired information or indicia. For example, the insert 110 may represent an insignia related to the brand of the club, a name of the club and/or the year the club was first sold.

Figure 1B:
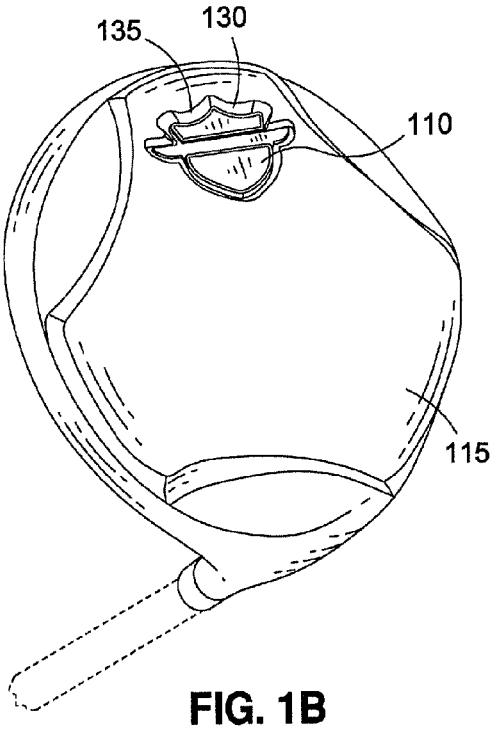
FIG. 1B illustrates the sole portion of FIG. 1A according to one or more embodiments described herein.

FIG. 1B illustrates a view of the sole portion 115 illustrating how the insert 110 may be positioned. Here, a recessed portion 130 is sized to receive the insert 110 and is shown to be fully defined in the sole portion 115. The recessed portion 130 may also have an outwardly tapered wall 135. The outwardly tapered wall 135 allows the edges of the insert 110 to be visible, thereby enhancing the aesthetic feel of the golf club head 100. As further illustrated, the insert 110 is positioned fully within the dimensions of the recessed portion 130 such that no portion of the insert 110 extends outside the recessed portion 130. However, if desired, the insert 110 may sit substantially flush inside the recessed portion.

While the recessed portion 130 and the insert 110 are proximate the sole portion 115 in this embodiment, it should be noted that the recessed portion 130 and the insert 110 may be located anywhere on the golf club head (a crown, a side portion, etc.) and further, at portions of the golf club outside the golf club head, (e.g., a shaft). However, positioning the insert 110 on the sole portion 115 as compared to the shaft may serve to maximize the benefits as discussed herein because the vibrations introduced to the golf club upon striking a golf ball are most pronounced at the golf club head.

In one aspect, the insert 110 and the recessed portion 130 include anti-rotation features. More particularly, the insert 110 and the recessed portion 130 may be non-circularly shaped and complementary to one another such that the insert 110, when secured within the recessed portion 130, is prevented from rotating (i.e., thereby rendering it non-rotatable). More particularly, the contours of the wall 135 engage and thus prevent the insert 110 from rotation within the recessed portion 130. Whereas a circular wall would not have any contours for preventing a complementary circular insert from rotating about, a non-circular wall may include at least portions that engage a non-circular insert from rotation. Such a feature is advantageous in the field of athletic equipment.

Considering that the placement of the insert 110 is on the sole portion 115 of the golf club head 100, contact between the insert 110 with a ground surface during swinging is common, and as such, anti-rotation of the insert 110 is a desirable feature to ensure that the insert 110 remains properly secured in a desired position.

Figure 1C:
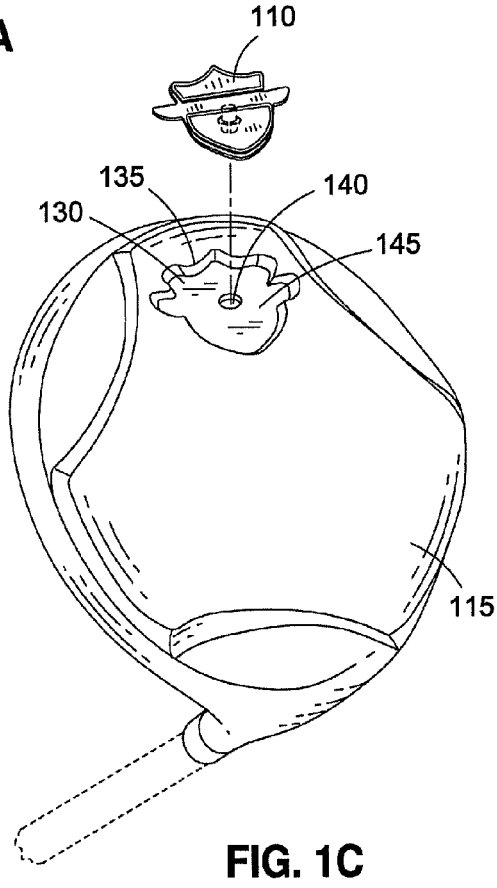
FIG. 1C illustrates an exploded view of the sole portion and the insert of FIG. 1B according to one or more embodiments described herein.

FIG. 1C illustrates an exploded view of the insert 110 and the golf club head 100. In this view, an aperture 140 is revealed. The aperture 140 may be fully defined within the recessed portion 130 of the sole portion 115. The aperture 140 may be located on a bottom surface 145 of the recessed portion 130, separated from the tapered wall 135. The aperture 140 extends from the bottom surface 145 and into the interior of the golf club head 100. That is, the aperture 140 extends through the entirety of a thickness of the portion of the wall of the golf club head 100 that corresponds with the recessed portion 130. The aperture 140 may be positioned anywhere on the bottom surface 145, but preferably near the geometric center of the bottom surface 145. Alternatively and/or in addition, the vertical axis passing through the center of the aperture 140 may be within 2 mm from the center of gravity of the insert 110, but preferably coincident with the center of gravity of the insert 110. By positioning the aperture 140 in this manner, durability of the insert 110 (after insertion) is improved.

Figure 2A:
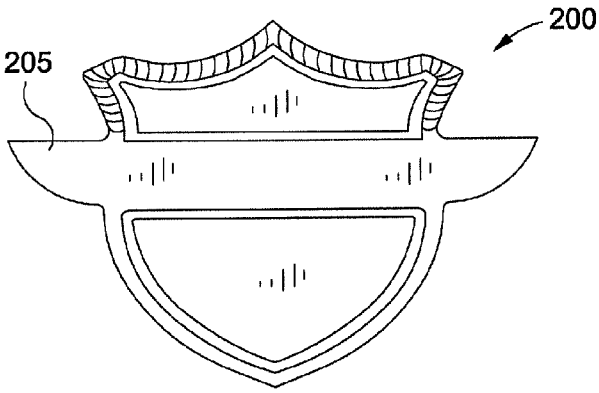
FIG. 2A illustrates a face of an insert according to one or more embodiments described herein.

FIG. 2A illustrates a front side of an insert 200, which may be an embodiment of the insert 110 of FIG. 1A. As shown, the front side comprises a display face 205. The display face 205 is visible when the insert 200 is positioned on a golf club head (e.g., golf club head 100), and may include design elements and aesthetic features. The display face 205 may include elements of varying depths. However, in other embodiments, the display face may be substantially flat. Among other materials such as plastics, rubbers, and the like, the display face 205 may be constructed out of aluminum, nickel or any other type of light metal.

Figure 2B:
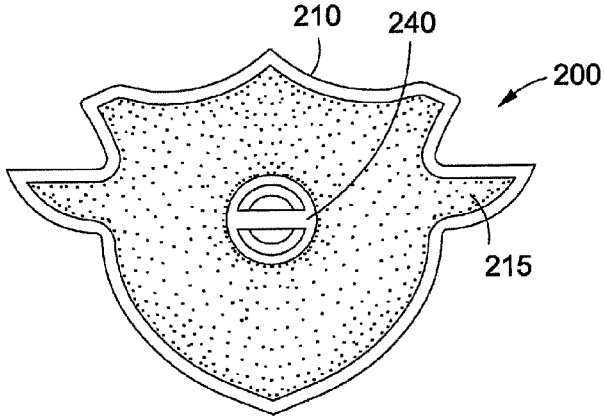
FIG. 2B illustrates a rear of the insert of FIG. 2A according to one or more embodiments described herein.
Figure 2C:
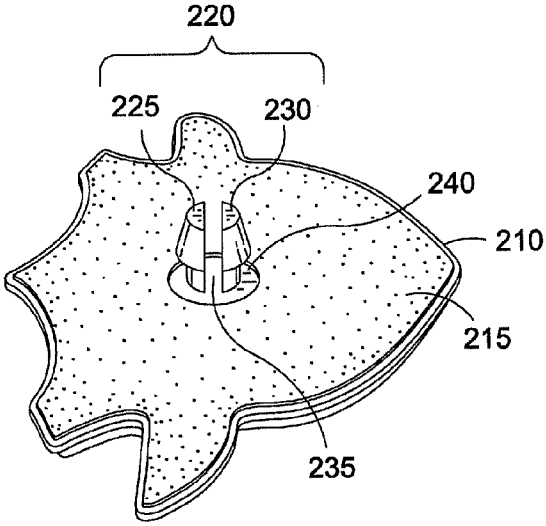
FIG. 2C illustrates a rear perspective view of the insert of FIG. 2A according to one or more embodiments described herein.

FIGS. 2B and 2C illustrate a back side of the insert 200. The back side of the insert 200 may include a rim 210 surrounding a back surface (the majority of which is obscured by an adhesive layer 215). In this manner, the rim 210 and the back surface form a shallow cavity for receiving the adhesive layer 215. Stated differently, the adhesive layer 215 is shaped to substantially fit within the circumferential boundary of the rim 210. However, the adhesive layer 215 may be slightly thicker than a depth of the cavity such that a portion of the adhesive layer 215 extends above an upper boundary of the rim 210. The function of the relatively thicker adhesive layer is to ensure that the rim 210 does not rattle against the sole portion of a golf club head in response to the vibrations created when the golf club head strikes a golf ball. The adhesive layer 215 may also include a cut-out portion 240 to allow a securing member 220 to protrude from the back surface. The securing member 220 may comprise a first prong 225 and a second prong 230. As shown, the securing member may have a gap 235 positioned between the first prong 225 and the second prong 230.

Figure 2D:
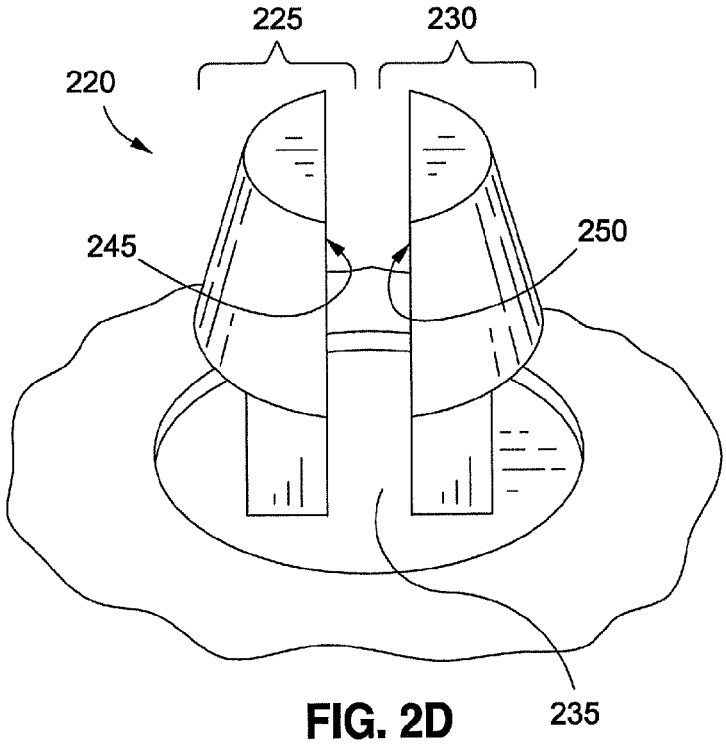
FIG. 2D illustrates a securing member of the insert of FIG. 2C according to one or more embodiments described herein.

FIG. 2D illustrates the securing member 220 in isolation for clarity.

The securing member 220 includes the first prong 225 and the second prong 230 separated by a gap 235 (e.g., a slit or a bore) which structurally isolates the first prong 225 from the second prong 230. The gap 235 allows the first prong 225 and second prong 230 to flex toward each other during an insertion operation. The gap 235 is the effect of orienting the first prong 225 and the second prong 230 such that the inner surfaces 245, 250 face each other. However, structurally, the first prong 225 and the second prong 230 are substantially similar. As such, FIG. 2E will only illustrate the first prong 225 for the sake of brevity. All descriptions attributed to the first prong 225 with respect to FIG. 2E are equally applicable to the second prong 230.

Figure 2E:
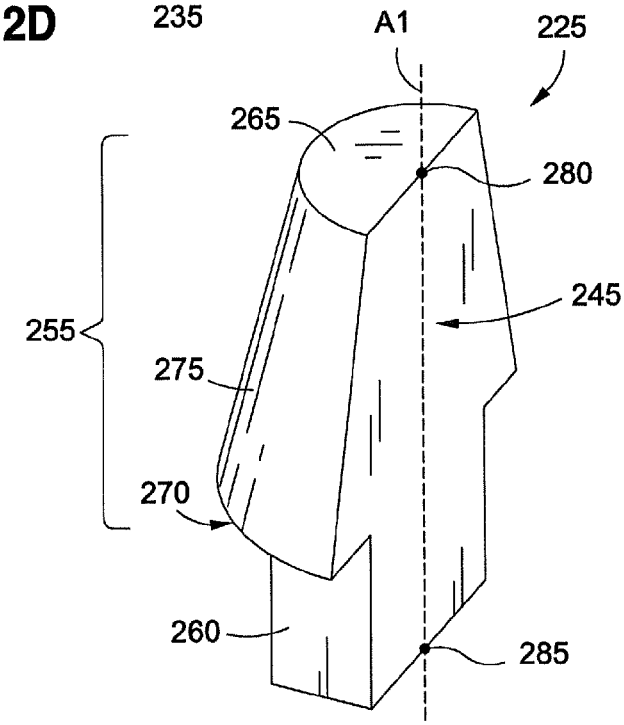
FIG. 2E illustrates one prong of the securing member of FIG. 2D according to one or more embodiments described herein.

As shown in FIG. 2E, the first prong 225 comprises a first head portion 255 and a first stem portion 260. The first head portion 255 may include a first leading surface 265, a first sidewall 275, and a first engagement surface 270. The first leading surface 265 may be flat and substantially parallel to a first engagement surface 270. As shown, the first leading surface 265 is separated from the first engagement surface 270 by the first sidewall 275. The first engagement surface 270 is coupled to an outer surface of the first stem portion 260 such the engagement surface 270 and the first stem portion 260 are orthogonal to one another. That is, at any cross-section taken of the first prong 225 about axis A1, the first engagement surface 270 and the outer surface of the first stem portion 260 form a right angle, thereby providing anti-removal characteristics in conjunction with the second prong 230 as discussed in more detail below. Axis A1, a midpoint axis, as shown, passes through a first midpoint 280 and a second midpoint 285. The first midpoint 280 occurs on the edge between the first leading surface 265 and the first inner surface 245, and the second midpoint 285 occurs at the common edge of the first inner surface 245, the first stem portion 260 and the back surface of the insert (not shown in FIG. 2E).

The securing member 220 is integrated into the back surface as shown in FIGS. 2B and 2C as implemented. However, in certain embodiments, the securing member is alternatively not integrated into the display face (not shown). For example, the securing member may be integrated into an intermediate plate, which is attached to the displace face. This configuration is advantageous in situations where the material of the securing member (e.g., plastic) is desired to be different than the material of the display face (e.g., aluminum). In these instances, the intermediate plate is disposed between the inner surface of the display face and the adhesive layer, and serves to couple the displace face and the adhesive layer. The thickness of the intermediate plate may be between 0.2 mm-1.2 mm. Here, the intermediate plate may have a flat surface on a first side, and may have the securing member protruding therefrom a second side opposite the first side. The first side may be attached to the inner surface of the display face and then the adhesive layer may be attached to the second side such that the cut-out portion of the adhesive layer allows the securing member to extend therethrough to complete construction of the insert. Accordingly, the insert may then be positioned on the golf club.

Figure 3A:
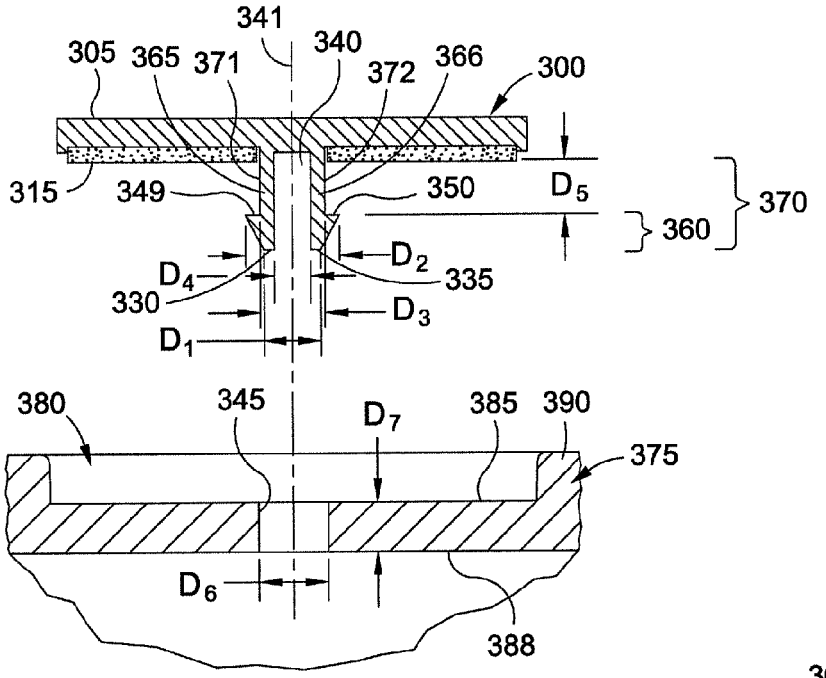
FIG. 3A illustrates a cross-section of an insert taken across a face center in an uncompressed state according to one or more embodiments described herein.
Figure 3B:
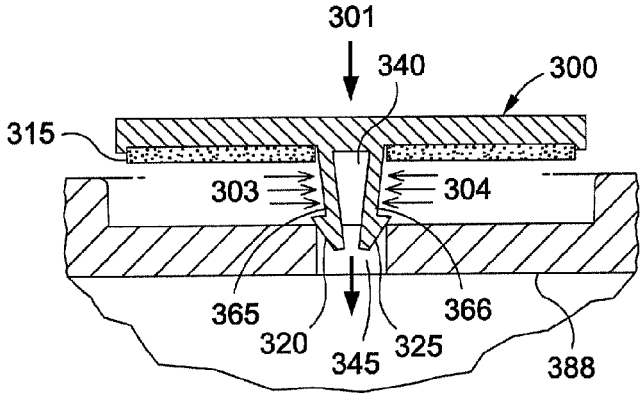
FIG. 3B illustrates a cross-section of the insert of FIG. 3A in a compressed state during an insertion operation according to one or more embodiments described herein.
Figure 3C:
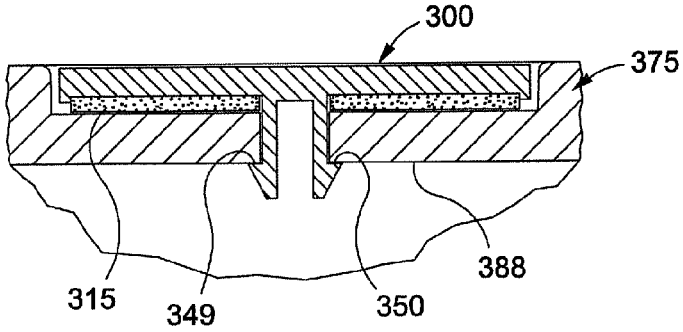
FIG. 3C illustrates a cross-section of the insert of FIG. 3A after completion of an insertion operation according to one or more embodiments described herein.

The basic structure of the certain embodiments of the insert having been described, attention will now be turned to the functionality of the insert. FIGS. 3A-3C collectively illustrate how the insert may toggle between an uncompressed state in FIG. 3A (prior to an insertion), to a compressed state in FIG. 3B (during insertion), and back to an uncompressed state in FIG. 3C (after completion of the insertion process).

More particularly, FIG. 3A illustrates how the insert may be aligned immediately prior to the insertion into aperture 345. FIG. 3A is a cross section taken across a plane passing through corresponding midpoint axes (e.g., Axis A1 as shown in FIG. 2E) on a first prong and a second prong in a pre-insertion state. As shown, an insert 300 may include a securing member 370. The securing member 370 may include a first prong 365 and a second prong 366. Each prong 365 and 366 may have a respective head portion (e.g., head portion 360) and a stem portion (e.g., stem portion 371). The securing member 370 is configured to be insertable through an aperture 345 formed on a recessed portion 380 of a golf club 375 (e.g., on the head of the golf club or on another part of the golf club).

FIG. 3B illustrates the effect when pressure 301 is exerted on the insert 300. Namely, the insert 300 is pressed into the aperture 345. As the first head portion 320 and the second head portion 325 of the head portion 360 move into the aperture 345, the tapered walls of the first head portion 320 and the second head portion 325 contact the edges of the golf club head as shown, and cause the first prong 365 and the second prong 366 to flex and compress toward each other as corresponding radial forces 303 and 304 are exerted on the prongs 365, 366. The tapered walls of the first head portion 320 and the second head portion 325 assist and act to guide the insert 300 into the aperture 345. The gap 340 helps to allow the prongs 371 and 372 to flex toward each other. As the engagement surfaces 349 and 350 are moved beyond the inner surface 388 of the golf club 375, the prongs 371 and 372 may uncompress and spring back into its uncompressed state to lock the insert 300 in place as shown in FIG. 3C.

As illustrated in FIG. 3C, after inserting the securing member 370 through the aperture 345, the securing member 370 locks into place filling the aperture 345. That is, the engagement surfaces 349 and 350 complement and engage the golf club head 375. Once locked, the securing member 370 prevents the insert 300 from being removed, rotated or repositioned. Specifically, the engagement surfaces 349 and 350 press against the inner surface 388 such that the securing member 370 cannot be pulled out of the aperture 345. In one or more embodiments, the engagement surfaces 349, 350 form a step from the stem portions 371 and 372. The step may be considered to form a transition region between the stem portions 371, 372 to the engagement surfaces 349, 350.

The adhesive layer 315 provides a second structural element for keeping the insert 300 locked in place acting as a holding substrate for coupling the insert 300 to the golf club 375.

The adhesive layer 315 may have a bonding material on a first surface to ensure adhesion to the insert 300. Additionally, the adhesive layer 315 may have bonding material (e.g., a glue, double sided tape, etc.) on a second surface to ensure adhesion to a bottom surface 385 of the recessed portion 380. Alternatively, the adhesive layer 315 may be a bonding substance.

The placement of the adhesive layer 315 generally sandwiched between the insert 300 and the recessed portion 380 of the golf club 375, further enhances the ability of the adhesive layer 315 to be in constant contact with both the recessed portion 380 and the golf club 375. In other words, after the adhesive layer 315, itself, is locked into place, the adhesive layer 315 remains in constant contact with both the recessed portion 380 and the golf club 375 thereby reinforcing the bond between the respective surfaces of the adhesive layer 315 and the insert 300 or the bottom wall 385 of the recessed portion 380.

In addition, the presence of the adhesive layer 315 may cause a small bias pressuring a portion of a wall contacted by both the adhesive layer 315 and engagement surfaces 349, 350 of the securing member 370, which only improves the seal and locking characteristics.

In one or more embodiments, the adhesive layer 315 may have a minimum thickness of 0.15 mm or more. For example, the thickness of the adhesive layer 315 may be between 0.2 and 0.35 mm. The adhesive layer 315 may be constructed out of closed cell foam and coated with an adhesive on both surfaces such that the adhesive layer 315 adheres to both the insert 300 and the recessed portion 380 (e.g., bottom wall 385 of the recessed portion 380). However, other materials and compositions may be used to construct the adhesive layer 315. In addition to preventing the insert 300 from being removed, the adhesive layer 315 is configured to be sufficiently thick in order to prevent the insert 300 from contacting the golf club and causing undesirable sound. Indeed, ensuring that the adhesive layer 315 has sound absorption characteristics is highly desirable in the field of golf club manufacturing as the "sound" of a golf club is an important characteristic to many golfers. Without an adhesive layer 315 of sufficient thickness to ensure that undesirable sounds are not present, each time the golf club is swung, the insert 300 may, for example, rattle.

It should be further apparent that because the adhesive layer 315 is sandwiched between the insert 300 and the golf club head 375, the securing member 370 cannot be further inserted into the aperture 345. In this manner, the insert 300 is locked in place.

As shown, the top surface 305 of the insert 300 is positioned flush with a top surface 390 of the recessed portion 380. However, if desired, the top surface 305 of the insert 300 may protrude slightly outside the top surface 390 of the recessed portion 380.

To perform the function of the insert described above, certain dimensional relationships between various structural elements of the insert 300 and the golf club 375 may exist. For example, as shown in FIG. 3A, a maximum edge-to-edge distance D1 with respect to leading portions 330 and 335 (as measured across a gap 340) is configured to be no greater than a diameter D6 of the aperture 345. These configurations allow the insert 300 to be pressed into the aperture 345.

However, a maximum edge-to-edge distance D2 with respect to engagement surfaces 349 and 350 (as measured across the gap 340) may be larger than the diameter D6 of the aperture 345. Accordingly, once the engagement surfaces 349 and 350 are moved through the aperture 345, the engagement surfaces 349 and 350 overlap the inner surface 388 and can press against the inner surface 388 of the golf club 375, thereby preventing the insert 300 from being pulled out of the aperture 345. In this manner, the insert 300 is uni-directional and cannot be moved in a reverse direction once the insert 300 is inserted into the aperture 345.

More particularly, as briefly discussed above, the angle formed between the engagement surface (e.g., 349) and the surface of the stem portion (e.g., 371) may be a right angle (or an acute angle in other embodiments) to provide said anti-removal characteristics and to additionally render the insert 300 uni-directional. An obtuse angle might not be preferred with respect to providing anti-removal characteristics.

The maximum diameter D3 across the stem portions 371 and 372 (as measured across the gap 340 and along any plane substantially perpendicular to the plane coincident with the gap axis 341) is no greater than diameter D6 of the aperture 345. In one embodiment, D3 is substantially equal to D6 such that the stem portions 371 and 372 fit within the aperture 345.

D5 represents a length of a portion of one of the stems 371 and 372 between a respective engagement surface 349 or 350 and the surface of the bottom of the adhesive layer 315.

D7 represents a thickness of the wall of the golf club between the bottom surface 385 and the inner surface 388. Since the aperture 345 extends through the entirety of the thickness of the wall, D7 may also represent the height of the aperture 345. As the portion of the stem 371 and 372 between the respective engagement surface 349 or 350 and the surface of the bottom of the adhesive layer is configured to reside within the aperture 345 when the insertion process is completed, D5 is no less than D7, and in one embodiment, D5≥D7.

Table 1 shown below includes data from two embodiments as well as a range of values corresponding to D1-D7 as discussed above. The numbers below are merely examples and should not be construed as limiting the scope of the invention.

TABLE 1

| FEATURE | RANGE | EMBODIMENT #1 | EMBODIMENT #2 |
|---|---|---|---|
| D1 | 2.5-5.0 mm | 3.4 mm | 3.0 mm |
| D2 | 3.0-7.5 mm | 4.0 mm | 4.4 mm |
| D3 | 2.5-5.0 mm | 3.5 mm | 3.5 mm |
| D4 | 0.8-3.5 mm | 2.0 mm | 1.0 mm |
| D5 | 0.5-3.0 mm | 1.1 mm | 0.9 mm |
| D6 | 2.5-6.0 mm | 3.6 mm | 4.0 mm |
| D7 | 0.5-3.0 mm | 1.05 mm | 0.7 mm |

Other relationships may exist between the various dimensions discussed with respect to FIG. 3A to ensure that the insert 300 fits properly as shown in FIG. 3C.

For example, (D2−D3)/2 represents the portion of each engagement surface which contacts the inner surface 388 of the golf club 375. To ensure that the insert 300 is held in place, the value of (D2−D3)/2 may have a minimum value of 0.25 mm. However, preferably, (D2−D3)/2≥0.45 mm. On the other hand, ensuring that the insert 300 is insertable into the aperture 345 should also be considered. For example, at the point of maximum flex (where a gap 340, wherein D4 representing the diameter, is narrowed to substantially zero as measured at the leading portion—i.e., when the respective edges of the leading portions are in contact with each other during an insertion process when the prongs are compressed towards one another), the maximum distance D2 should be less than the size of the aperture D6 to ensure that the insert 300 will fit within the aperture 345.

Figure 4:
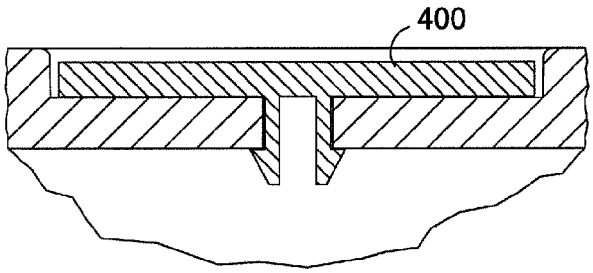
FIG. 4 illustrates an insert without an adhesive layer according to one or more embodiments described herein.

FIG. 4 illustrates an embodiment of an insert 400 without requiring an adhesive layer. For example, where the material of the insert 400 is non-metallic (e.g., a rubber, foam, etc.) or where the material of the golf club head is non-metallic, an adhesive layer for cushioning might not be needed. However, a glue or other adhesive coating (not shown) may still be utilized to further hold the insert 400 in place.

Figure 5:
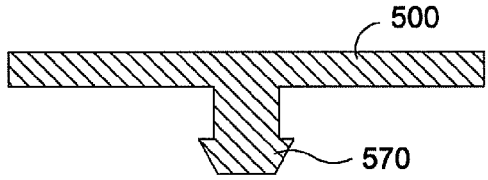
FIG. 5 illustrates an insert having a securing member without a gap according to one or more embodiments described herein.

FIG. 5 illustrates an insert 500 having a securing member 570 without a gap. Where the material constructing the insert 500 is a rubber, soft plastic, etc., the material itself may have some compressible qualities that enable it to fit within an aperture smaller than a maximum diameter of the securing member 570. In this manner, the insert 500 may be secured to a golf club without a gap present in the securing member 570.

Figure 6:
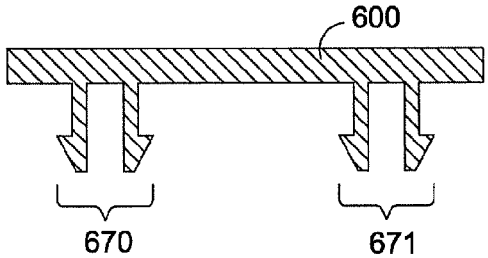
FIG. 6 illustrates an insert including a plurality of securing members according to one or more embodiments described herein.

FIG. 6 illustrates an insert 600 with a plurality of securing members 670 and 671. While not shown to scale, insert 600 may be twice as large as, for example, insert 110 of FIG. 1A-1C. Larger inserts, such as insert 600, can benefit from employing a plurality of securing members. Each of the securing members 670 and 671 may behave similarly to securing member 220 of FIG. 2C.

Figure 7:
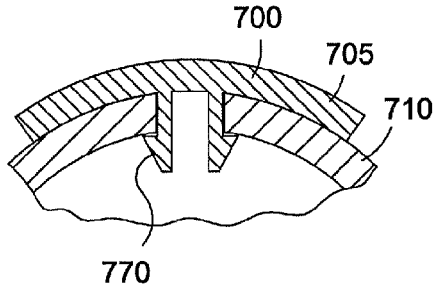
FIG. 7 illustrates a curved insert according to one or more embodiments described herein.

FIG. 7 illustrates an insert 700 that might include a curved inner surface 705 secured in place against a curved golf club surface 710 by securing member 770. It should be appreciated that other irregular surfaces may still be able to employ securing members (with or without an adhesive layer) to lock the insert in place.

Figure 8:
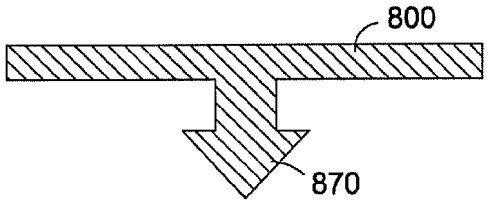
FIG. 8 illustrates an insert with an arrow-shaped securing member according to one or more embodiments described herein.
Figure 9:
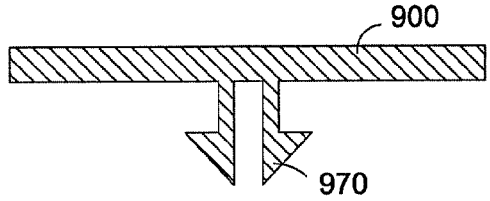
FIG. 9 illustrates an insert with an arrow-shaped securing member with a gap according to one or more embodiments described herein.

Further alternatives to the shape of the head portion of a securing member may be possible. For example, FIG. 8 illustrates an arrow-shaped head 870 as part of insert 800. As shown, the arrow-shaped head 870 might not include a gap. FIG. 9 illustrates a variation on insert 900 where a gap is included within an arrow-shaped head 970.

Figure 10:
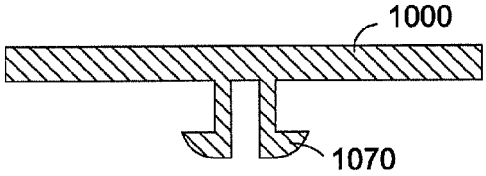
FIG. 10 illustrates an insert with a securing member having a rounded head according to one or more embodiments described herein.

FIG. 10 illustrates an insert 1000 having a pair of prongs 1070 which have a rounded tip.

Although various components are illustrated in one or more of the figures, it should be understood that any combination of the various components may be utilized in different embodiments. Any combination of components is within the scope of the present invention.

Unless otherwise indicated, all numbers expressing quantities should be understood to have minor manufacturing tolerances, and accordingly, as used in the specification and claims are to be understood as being modified in all instances by the term "about." Thus, unless indicated to the contrary, the numerical parameters set forth in the specification and attached claims are approximations that may vary depending upon the desired properties sought to be obtained by the present invention.

At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

The terms "a," "an," "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments of this invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Specific embodiments disclosed herein may be further limited in the claims using consisting of or and consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of the invention so claimed are inherently or expressly described and enabled herein.

In closing, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

I claim:

1. A golf club head, comprising:

a top portion;

a striking face coupled to the top portion;

a sole portion coupled to the striking face, the sole portion including an inner surface and an outer surface, the sole portion further defining an aperture extending therethrough;

a uni-directional, non-rotatable insert including a face and a securing member, the securing member comprising a stem portion and a head portion, the securing member configured to contact the inner surface for securing the insert to the sole portion, the face including a rim that surrounds the face; and an adhesive layer located between the outer surface and the face, the adhesive layer covering the entirety of the face within the rim and including an opening through which the stem passes, the adhesive layer having a thickness greater than a height of the rim.

2. The golf club head of claim 1, wherein the securing member includes a gap that extends from a tip of the head along a direction of the stem axis, the gap subdividing the head portion into a first head portion and a second head portion.

3. The golf club head of claim 2, wherein the aperture has an aperture diameter, the stem portion having a stem diameter wherein the aperture diameter is substantially equivalent to the stem diameter such that the stem portion is configured to extend through the aperture.

4. The golf club head of claim 3, wherein the head portion includes a engagement surface proximal the stem portion and having an engagement diameter, the head portion further includes a leading surface distal the stem portion and having a leading diameter.

5. The golf club head of claim 4, wherein the engagement diameter is greater than the aperture diameter and the leading diameter no greater than the aperture diameter.

6. The golf club head of claim 5, wherein the head portion further includes a tapered wall which couples the leading surface and the engagement surface.

7. The golf club head of claim 5, wherein when the head portion is inserted into the aperture, the first head portion and the second head portion flexes toward one another until the engagement surface contacts the inner surface of the sole portion.

8. The golf club head of claim 1, wherein a thickness of the aperture is substantially equal to the difference of the thicknesses of the stem and the adhesive layer.

9. The golf club head of claim 1, wherein a transition region proximal the stem portion and head portion includes a step.

10. A golf club head, comprising:

a top portion;

a striking face coupled to the top portion;

a sole portion coupled to the striking face, the sole portion including a recessed portion defining an aperture, the recessed portion having an inner wall and outer wall; and a uni-directional, non-rotatable insert including:

a face including a rim that surrounds the face, an adhering layer having a first surface for contacting and adhering to the face and having a second surface opposite the first surface for contacting and adhering to the recessed portion of the sole portion, a securing member adjacent the second surface of the adhering layer, the securing member configured to be insertably locked into the sole portion, the securing member comprising a stern portion and a head portion, and an adhesive layer located between the outer wall and the face, the adhesive layer covering the entirety of the face within the rim and including an opening through which the stern passes, the adhesive layer having a thickness greater than a height of the rim.

11. The golf club head of claim 10, wherein the securing member comprises a stem and a head, the stem positioned between the head and the face.

12. The golf club head of claim 11, wherein a maximum diameter of the head is greater than a maximum diameter of the stem.

13. The golf club head of claim 12, wherein a maximum diameter of the head is greater than a maximum diameter of the aperture, and a maximum diameter of the stem is no greater than a maximum diameter of the aperture.

14. The golf club head of claim 13, further comprising a bore extending through the head.

15. The golf club head of claim 14, wherein the bore further extends through the stem.

16. The golf club head of claim 15, wherein the bore is configured to allow the head to temporarily flex from an uncompressed state to a compressed state when the head is inserted into the aperture.

17. The golf club head of claim 16, wherein the bore is further configured to allow the head to return to the uncompressed state when a surface of the head defining the maximum diameter engages the inner wall.

* * * * *